United States Patent [19]

Williamson

[11] 4,087,802

[45] May 2, 1978

[54] METHOD AND APPARATUS FOR ELECTRONIC SURVEILLANCE OF PRECISELY DEFINED CONTROL ZONE

[76] Inventor: Robert D. Williamson, 7350 NW. First Ct., Pembroke Pines, Fla. 33024

[21] Appl. No.: 689,336

[22] Filed: May 24, 1976

[51] Int. Cl.[2] ..... G08B 13/22

[52] U.S. Cl. ..... 340/280; 340/258 C

[58] Field of Search ..... 340/258 C, 280, 408

[56] References Cited

U.S. PATENT DOCUMENTS

| | | | |
|---|---|---|---|
| 3,707,711 | 12/1972 | Cole et al. | 340/258 C |
| 3,895,368 | 7/1975 | Gordon et al. | 340/258 C |
| 3,996,555 | 12/1976 | Dow | 340/258 C |

*Primary Examiner*—Glen R. Swann, III

*Attorney, Agent, or Firm*—Robert J. Van Der Wall

[57] ABSTRACT

A high frequency generator projects an electronic wave into a control zone under surveillance to establish a first field. A frequency modulated (FM) generator is used for establishing a second field throughout the zone. A third field of the same FM carrier frequency, but with a different modulation, is established only at extreme ends of the control zone to define the limits of the control zone. Presence only within the control zone of a transponder causes the reradiation of a signal comprised of the FM signal and the high frequency signal, which in turn activates an alarm circuit.

14 Claims, 5 Drawing Figures

WARNING CIRCUIT
72
70
FILTER
68

20
21'
F M RECEIVER
135
138
37
36
15
CONTROL ZONE TYPICALLY 8 TO 10 FT.
38
34
36
14
134
138
13
16

64
ALARM CIRCUIT
62
60
FILTER
33
133
32
FREQUENCY MODULATED OSCILLATOR
132
FREQUENCY MODULATED OSCILLATOR
31
131
22
OSCILLATOR
OSCILLATOR
122
21
F M RECEIVER
12
DIRECTIONAL COUPLER
11
17
10
H. F. OSCILLATOR
H. F. DETECTOR
18
19

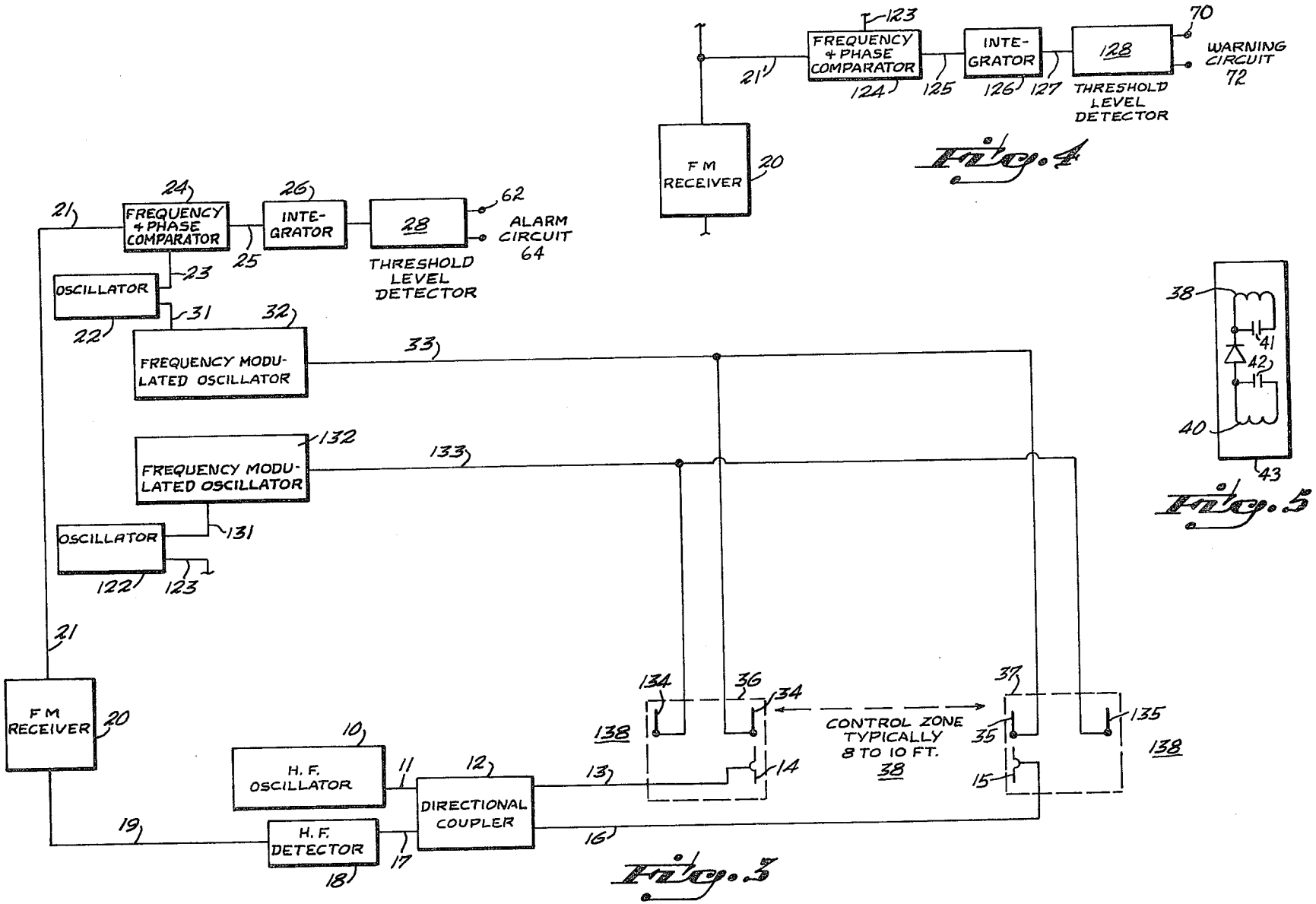
WARNING CIRCUIT 72
70
128
THRESHOLD LEVEL DETECTOR
INTE-GRATOR
127
126
125
123
FREQUENCY + PHASE COMPARATOR
124
21
20
F M RECEIVER
38
41
42
40
43
135
138
37
35
15
CONTROL ZONE TYPICALLY 8 TO 10 FT. 38
34
36
14
134
13
16
DIRECTIONAL COUPLER
12
11
17
10
H. F. OSCILLATOR
H. F. DETECTOR
18
19
ALARM CIRCUIT 64
62
28
THRESHOLD LEVEL DETECTOR
26
INTE-GRATOR
25
24
FREQUENCY + PHASE COMPARATOR
23
31
32
FREQUENCY MODU-LATED OSCILLATOR
33
132
FREQUENCY MODU-LATED OSCILLATOR
133
131
123
OSCILLATOR
22
OSCILLATOR
122

METHOD AND APPARATUS FOR ELECTRONIC SURVEILLANCE OF PRECISELY DEFINED CONTROL ZONE

FIELD OF THE INVENTION

The present invention relates to an improved method and apparatus for pilferage control that detects the presence of a telltale element in a precisely defined control zone. More particularly, it is directed both to a method and apparatus that defines in a predetermined manner the precise dimensions of a control zone, and which subjects said control zone to electronic surveillance.

BACKGROUND OF THE INVENTION

It is established in the art to secure specially constructed telltale elements or tags to merchandise which is likely to be pilfered, and it is known to electronically monitor the exits of stores and warehouses, etc., and even of zones within them where such merchandise is dispensed to ascertain that the tags are deactivated or detached in the manner provided for authorized removal of the merchandise. In the past various methods and apparatus along these lines have been employed, as recited in U.S. Pat. Nos. 3,895,368, 3,711,848, and 3,707,711, but many of these known methods and apparatus have limitations on their reliability, tolerance and sensitivity. Some are susceptible to false triggering by metallic structures coincidentally manifesting similar properties to the special tags. In some, proximity of the human body to the apparatus tends to mask the effect of the equipment and to interfere with reliable operation.

The limitation on the method and apparatus disclosed in the above patents are such that their respective systems have proved incapable of discerning with a high level of reliability whether a tab has been moved into a zone being monitored, i.e., a control zone, or is merely in proximity to it. This causes too many false alarms when there is no telltale tage actually in the control zone.

There is the further limitation on the method and apparatus disclosed in U.S. Pat. No. 3,895,368 because in that patent the frequencies selected for use therein were limited by an attempt to avoid frequencies that would be very susceptible to false triggering.

SUMMARY OF THE INVENTION

With the foregoing in mind, it is a primary object of the present invention to provide a method and apparatus for precisely defining by predetermined limitations a control zone, within which is electronically detected the presence of a telltale element and hence unauthorized movement of merchandise.

It is further an object of the present invention to minimize the inadvertent triggering of an electronically monitored control zone alarm by the presence of a telltale element in proximity to, but outside of, the control zone.

it is another object of the present invention to provide a signal which will give a preliminary or warning signal when a telltale element is moved close to the control zone but without actually generating a false alarm that a telltale element is actually in the control zone.

It is a resulting object of the present invention that the warning signal provides advance notice that a telltale element is about to enter the control zone, thereby allowing more time to respond thereto.

It is a further object of the present invention to provide a device which allows greater flexibility in the choice of frequencies and components capable of being used in the apparatus or in practicing the method of electronic surveillance of a control zone by the use of a means for precisely defining the limits of the control zone.

Other objects and advantages will become apparent upon reading the following descriptions of the invention and upon reference to the drawings.

In accordance with the present invention there is provided an apparatus for detecting only within a quite precisely defined control zone the presence of a telltale element, which is a transponder which has signal mixing capability. The apparatus includes a source of high frequency (HF) signals; means coupled to the source of the HF signals for propagating in the control zone an electronic wave corresponding to the HF signals which means may include transducers or antennae; a first source of center reference low frequency (LF) signals; a first modulation oscillator coupled to the first source of LF signals to frequency modulate (FM) said first source of LF signals; a first means; which may be transducers or antennae, coupled to the first source of FM signals for establishing through the control zone an electronic field corresponding to the first source of FM signals; a second source of center reference LF signals with the same center frequency as the first source of LF signals, but coupled to a second modulation oscillator having a different characteristic than the first modulation oscillator; a second means, which may also be transducers or antennae, coupled to the second source of FM signals for establishing throughout the marginal area an electronic field corresponding to the second source of FM signals and thereby precisely defining the limits of said control zone; signal detecting means; means for coupling the detecting means with the control zone for receiving the signals therefrom, with the detecting means being constructed and arranged to detect the FM signals only when received, in combination with the HF signals; and a first means coupled to the detecting means for activating an alarm circuit responsive to the detection, when that occurs, of the first source of the FM signals. Alternatively, there may be provided a second means coupled to the detecting means for activating a warning circuit responsive to the detection, when that occurs, of the second source of the FM signals.

In accordance with another aspect of the present invention there is provided a method for detecting within a control zone the presence of a transponder which has signal mixing capability, said method comprising the steps of generating HF signals; propagating through a control zone an electronic wave corresponding to the HF signals; generating LF signals using a first oscillator; frequency modulating said first LF oscillator with a first modulation oscillator; establishing through the control zone an electronic field corresponding to the FM signals, modulated by the first oscillator; generating further LF signals with a second oscillator having the same center frequency as the first LF oscillator; modulating the further LF signals using a second modulation oscillator; establishing throughout the marginal area an electronic field corresponding to the FM signals modulated by the second oscillator, to precisely define the limits of the control zone; detecting the signals in such manner as to detect the FM signals only when received in combination with the HF signals; and translating the detection, when that occurs, of those FM signals, modulated by the first oscillator, into activation of an alarm circuit. Alternatively, the method comprises the additional step of translating the detection, when that occurs, of FM signals, modulated by the second oscillator, into activation of a warning circuit.

The invention will be better understood after reading the following detailed description of the embodiments thereof with reference to the appended drawings, in which:

DESCRIPTION OF THE DRAWINGS

FIG. 3 is a block diagram of the invention showing a preferred embodiment of the filter shown in FIG. 1;

FIG. 4 is a block diagram of the invention showing a preferred embodiment of the filters when both warning and alarm functions are utilized as generally disclosed in FIG. 2;

FIG. 5 is a schematic diagram of a typical transponder having signal mixing capability.

DETAILED DESCRIPTION OF THE PREFERRED EMBODIMENTS

Figures 1, 2:
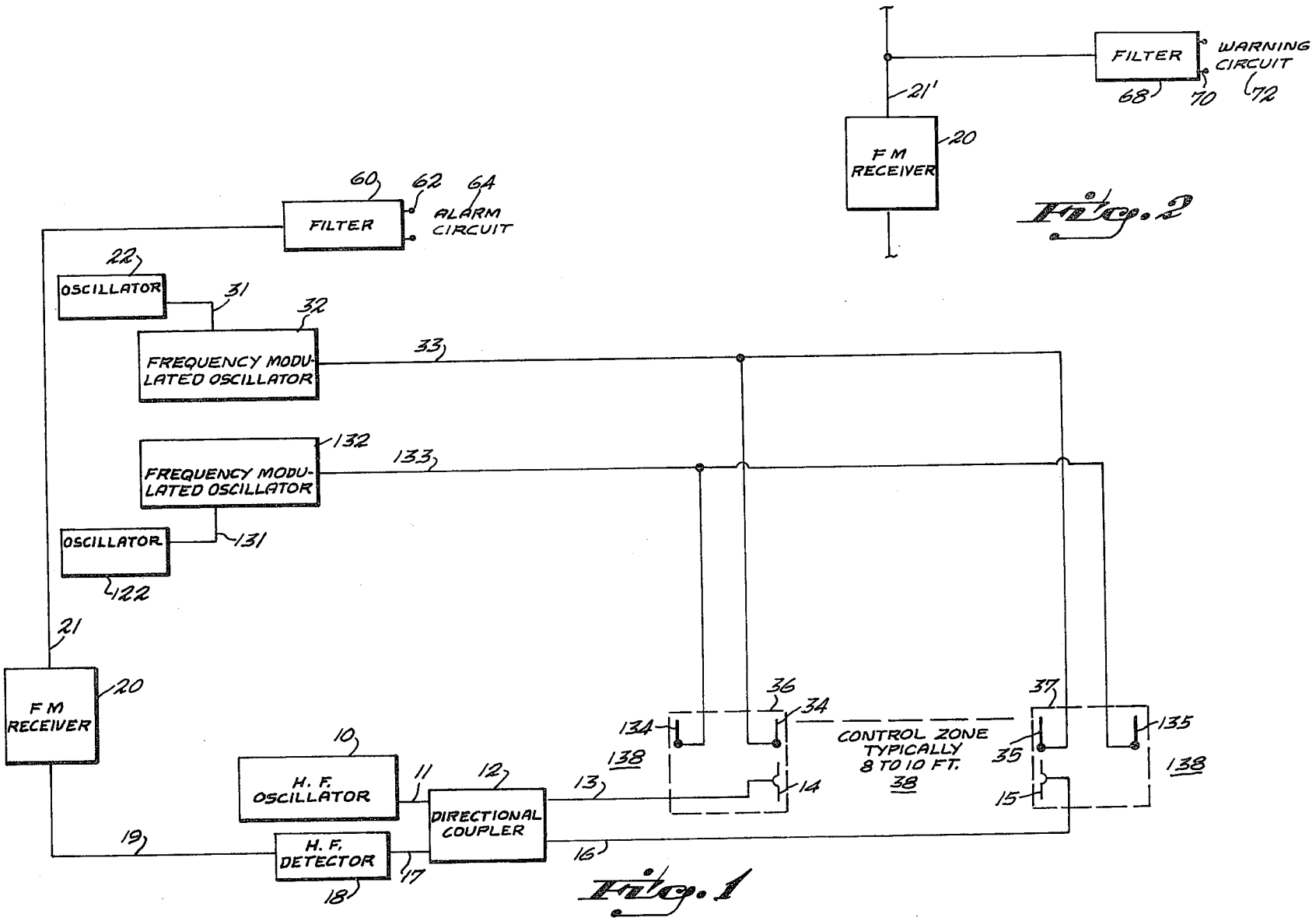
FIG. 1 is a block diagram of a surveillance system constructed in accordance with the invention.
FIG. 2 is a block diagram of an alternative embodiment of the invention showing the utilization of both alarm and warning functions.

Referring to FIG. 1, a first oscillator 32 generates a center reference frequency, which is frequency modulated (FM) by oscillator 22 via conductor means 31. The FM output of the first oscillator 32 is fed via conductor 33 to signal transmitting means 34 and 35 and radiated into a control zone, 38.

There is also provided a second oscillator 132 which generates the same center reference frequency as the first oscillator 32. The center reference frequency from second oscillator 132 is frequency modulated by oscillator 122 via conductor 131. The FM output of the second oscillator 132 has different characteristics than the FM output of the first oscillator 32. The FM output of the second oscillator 132 is fed via conductor 133 to signal transmitting means 134 and 135 and radiated into the marginal area 138 outboard of the control zone 38. Signal transmitting means 34, 35, 134 and 135 may be located in housings represented symbolically by the phantom lines 36 and 37.

A HF oscillator 10 functions as a source of HF signals and has its output connected over conductor 11, to a directional coupler 22. Outputs of the directional coupler are connected via conductors 13, 16 to their respective signal transmitting and receiving means 14, and 15. The signal transmitting and receiving means 14 and 15 may also be located in the housings represented symbolically by the phantom lines 36 and 37. The nature of the directional coupler 12 is such that most of the signal from the source 10 is divided evenly to the conductors 13 and 16. However, a small amount of output from the coupler 12, termed leakage, does flow through to conductor 17. This leakage is utilized to bias a HF detector 18, providing a reference.

The area under surveillance, termed the control zone 38, is located between the enclosures 36 and 37. For this reason elements 34 and 14 on one side of the space confront elements 35 and 15 on the opposite side. Signal transmitting means 134 and 135 are on the back of the enclosure radiating behind the housings. This concentrates the energy from signal transmitting means 34 and 35 between housings 36 and 37 and places the principal energy from the signal transmitting means 134 and 135 outboard of the control zone between the housings 36 and 37.

In this configuration, when a transponder, such as shown in FIG. 5, is moved into the control zone, it will reradiate a composite signal to signal transmitting and receiving means 14 and 15 which will be primarily the signal radiated from signal transmitting means 34 and 35, combined with that from signal transmitting and receiving means 14 and 15. However, some of the composite signal reradiated from the transponder may be a signal component radiated from signal transmitting means 134 and 135 combined with a signal component from transmitting and receiving means 14 and 15.

The signals received by signal transmitting and receiving means 14 and 15 pass through conductors 13 and 16 to the directional coupler 12, where they are combined with very little loss, isolated from signals on path 11, and sent out conductor 17 to the HF detector 18. In a known and standard manner, the HF detector 18 will remove the HF component and supply the detected FM signals via path 19 to the FM receiver 20.

The FM receiver 20 is tuned to the common center reference frequency of the FM oscillators 32 and 132. It is a well known fact that an FM receiver will only "lock on" to the strongest of a plurality of slightly different signals that are within its pass band. Therefore, the FM receiver 20 will select the FM signal radiated from signal transmitting means 34 and 35 while the transponder is in the control zone, despite the fact that some signal from transmitting means 134 and 135 may have also been picked up. This is because signal radiated from transmitting means 34 and 35 will be stronger when the transponder is in the control zone than the signal from transmitting means 134 and 135.

In like manner, if the transponder is moved to the outboard or marginal area 138, the composite signal reradiated to signal transmitting and receiving means 14 and 15 will be primarily the signal radiated from signal transmitting means 134 and 135 combined with the HF signal later removed by HF detector 18. Secondarily, signals from transmitting means 34 and 35 may be included in the composite signal, but the FM receiver 20 will again "lock on" to the strongest signal, in this case the one radiated from signal transmitting means 134 and 135 because the transponder is in the marginal area 138.

The output of FM receiver 20 is connected via conductor 21 to filter 60. Filter 60 is constructed such that signals from transmitting means 34 and 35, which originated in oscillator 32, will pass through it relatively unaffected. However, other signals will be greatly attenuated. Thus, if the transponder is located in the marginal area 138, and signals from transmitting means 134 and 135 accordingly predominate over signals from transmitting means 34 and 35, the FM receiver 20 will lock on to the signals from the transmitting means 134 and 135 which originate in oscillator 132, and the output from FM receiver 20 will exclude any signals to which filter 60 is receptive. Therefore, when the transponder is in the marginal area 138, the output from FM receiver 20 will be greatly attenuated by filter 60, and will be insufficient to trigger the alarm circuit 64.

Contrarywise, if the transponder is moved into the control zone 38, signals from transmitting means 34 and 35, originating in oscillator 32, will predominate and will pass through FM receiver 20 via conductor 21 to filter 60, which will pass those signals through relatively unaffected. The output from filter 60 is connected via conductor 62 to an alarm circuit 64.

Turning now to FIG. 2, there is shown an alternative embodiment, wherein the output of the FM receiver 20 is additionally connected via a conductor 21' to a filter 68. This filter 68 is constructed such that signals from transmitting means 134 and 135, which originated in oscillator 132, will pass through it relatively unaffected. However, other signals will be greatly attenuated. The output from filter 68 is connected via conductor 70 to a warning circuit 72. The signals attenuated by filter 68 will be insufficient to trigger the warning circuit 72.

FIG. 5 shows a preferred embodiment of the transponder circuit, wherein each terminal of a diode 39 is connected to parallel inductance and capacitance elements, 38 and 41 and 40 and 42 respectively which are embedded in a carrier and comprises a telltale tag 43.

Turning now to FIG. 3, there is shown a preferred embodiment of the filter 60 that is shown in FIG. 1. In this configuration, oscillator 22 has its output additionally connected via conductor 23 to a frequency and phase comparator 24, which also receives the output of FM receiver 20 via conductor 21. The output of the frequency and phase comparator 24 passes over path 25 to integrator 26, and thence over conductor 27 to a threshold level detector 28, such as a Shmitt trigger. If the comparator 24 determines that the frequency and phase of the signals received from oscillator 22 and FM receiver 20 are identical for a given period of time, then the output from the integrator 26 on conductor 27 will rise to the triggering point of the threshold level detector 28, activating the alarm circuit 64 via conductor 62.

Finally, turning to FIG. 4, there is shown an alternative embodiment analogous to that described above in regard to FIG. 2, wherein the filter 68 may comprise a frequency and phase comparator 124, connected both to oscillator 122 (shown in FIGS. 3) by conductor 123 and to FM receiver 20 by conductor 21', an integrator 126 connected to the comparator 124 by conductor 125; a threshold level detector 128 connected via path 127 to the integrator 126. If the comparator 124 determines that the frequency and phase of the signals received from the oscillator 122 and FM receiver 20 are identical for a given period of time, then the output from the integrator 126 on conductor 127 will rise to the triggering point of the threshold level detector 128, activating the warning circuit 72 via conductor 70.

Having described the presently preferred embodiments of the invention it should be understood that various changes in construction and arrangement will be apparent to those skilled in the art and are fully contemplated herein without departing from the true spirit of the invention. Accordingly, there is covered all alternatives, modifications and equivalents as may be included within the spirit and scope of the invention as defined by the appended claims.

What is claimed is:

1. A method for detecting within a control zone and a marginal area the presence of a transponder having signal mixing capability and energizing an alarm circuit comprising the steps of:

generating HF signals;

propagating through the control zone an electronic wave corresponding to the HF signals;

generating first center reference frequency signals;

frequency modulating the first center reference frequency signals using a first modulation oscillator, establishing through the control zone an electronic field corresponding to the first frequency modulated (FM) signals;

generating second center reference frequency signals;

frequency modulating the second center reference frequency signals using a second modulation oscillator to create signals having different characteristics than the first FM signals;

estabilishing in the marginal area an electronic field corresponding to the second FM signals;

detecting the signals in such manner as to detect the FM signals only when received in combination with HF signals; and translating the detection of the first FM signals into the activation of the alarm circuit only when the first FM signals predominate over the second FM signals.

2. A method for detecting within a control zone the presence of a transponder having signal mixing capability, as recited in claim 1, wherein translating the detection of first FM signals into activation of the alarm circuit only when the first FM signals predominate over the second FM signals, comprises the steps of:

conducting the FM signals to an FM receiver for selection of the strongest FM signal;

feeding the FM receiver output to a filter;

filtering out all FM receiver output signals except those having the characteristics of the first FM signals; and activating the alarm circuit by means of the output of the filter.

3. A method for detecting within a control zone the presence of a transponder having signal mixing capability, as recited in claim 2, wherein feeding the FM receiver output to a filter and filtering out all FM receiver output signals except those having the characteristics of the first FM signals comprises the steps of:

conducting the output of the first modulation oscillator to a frequency and phase comparator;

feeding to the frequency and phase comparator the output of the FM receiver;

comparing in the frequency and phase comparator the characteristics of the first modulation oscillator output and the FM receiver output;

permitting an output from the frequency and phase comparator only when the characteristics of the first modulation oscillator output and the FM receiver output are essentially identical;

conducting the frequency and phase comparator output to an integrator;

integrating the frequency and phase comparator output to a point sufficient to trigger a threshold level detector;

conducting the integrator output to a threshold level detector; and conducting the output of the threshold level detector to the alarm circuit.

4. A method for detecting within a control zone and a marginal area the presence of a transponder having signal mixing capability, as recited in claim 1, further comprising the step of:

translating the detection of the second FM signals into the activation of a warning circuit, only when the second FM signals predominate over the first FM signals.

5. A method for detecting within a control zone and a marginal area the presence of a transponder having signal mixing capability, as recited in claim 4, wherein translating the detection of first and second FM signals, respectively, into activation of the alarm circuit and activation of the warning circuit comprises the steps of:

supplying the FM signals to an FM receiver for selection of the strongest FM signal;

feeding the fM receiver output to two filters in parallel;

filtering out with a first filter all FM receiver output signals except those having the characteristics of the first FM signals;

activating the alarm circuit by means of the output of the first filter;

filtering out with a second filter all FM receiver output signals except those having the characteristics of the second FM signals;

activating the warning circuit by means of the output of the second filter.

6. A method for detecting within a control zone and a marginal area the presence of a transponder having signal mixing capability, as recited in claim 5, wherein the steps of filtering with a first and second filter all FM receiver output signals, activating the alarm circuit and activating the warning circuit comprise the steps of:

feeding to the first frequency and phase comparator the output of the FM receiver;

comparing in the frequency and phase comparator the characteristics of the first modulation oscillator output and the FM receiver output;

permitting an output from the first frequency and phase comparator only when the characteristics of the first modulation oscillator output and the FM receiver output are essentially identical;

conducting the first frequency and phase comparator output to a first integrator;

integrating the first frequency and phase comparator output to a point sufficient to trigger a first threshold level detector;

conducting the first integrator output to the first threshold level detector;

conducting the output of the first threshold level detector to the alarm circuit;

feeding to the second frequency and phase comparator the output of the FM receiver;

comparing in the frequency and phase comparator the characteristics of the second modulation oscillator output and the FM receiver output;

permitting an output from the second frequency and phase comparator only when the characteristics of the second modulation oscillator output and the FM receiver output are essentially identical;

conducting the second frequency and phase comparator output to a second integrator;

integrating the second frequency and phase comparator output to a point sufficient to trigger a second threshold level detector;

conducting the second integrator output to the second threshold level detector; and conducting the output of the second threshold level detector to the warning circuit.

7. A method for detecting within a control zone and a marginal area the presence of a transponder having signal mixing capability, as recited in claim 1, wherein detecting the signals in such manner as to detect the FM signals only when received in combination with HF signals further comprises removing HF signals from composite HF and FM signals received.

8. An apparatus for detecting within a control zone and a marginal area the presence of a transponder having signal mixing capability and energizing an alarm circuit, said apparatus comprising:

a means for generating HF signals;

means coupled to the source of the HF signals for propagating through the control zone an electronic wave corresponding to the HF signals;

a first source of center reference low frequency (LF) signals;

a first modulation oscillator coupled to the first source of LF signals to frequency modulate (FM) the first source of LF signals creating a source of first FM signals;

a first means coupled to the source of first FM signals for establishing through the control zone an electronic field corresponding to the first FM signals;

a second source of center reference LF signals with the same center frequency as the first source of LF signals;

a second modulation oscillator having a different characteristic than the first modulation oscillator and coupled to the second source of LF signals to frequency modulate (FM) the second source of LF signals creating a source of second FM signals;

a second means coupled to the source of second FM signals for establishing throughout the marginal area an electronic field corresponding to the second FM signals;

signal detecting means constructed to detect FM signals only when received as a composite with the HF signals;

means for coupling the signal detecting means with the control zone for receiving the signals therefrom; and a means coupled to the signal detecting means for providing activation of the alarm circuit responsive to the detection of the first FM signals, only when the first FM signals predominate over the second FM signals.

9. An apparatus for detecting within a control zone the presence of a transponder having signal mixing capability, as recited in claim 8, wherein the means for providing activation of the alarm circuit responsive to the detection of the first FM signals, only when the first FM signals predominate over the second FM signals comprises:

an FM receiver connected to signal detecting means to select the strongest FM signals;

a filter connected to the output of the FM receiver to attenuate all FM signals except those having the characteristics of the first FM signals; and the alarm circuit which is connected to the output of the filter for activation by the output of the filter.

10. An apparatus for detecting within a control zone the presence of a transponder having signal mixing capability, as recited in claim 9, wherein the filter comprises:

a frequency and phase comparator connected to the outputs of both the FM receiver and the first modulation oscillator for comparing the characteristics of the first modulation oscillator output and the FM receiver output and permitting an output from the frequency and phase comparator only when the first modulation oscillator output and the FM receiver output are essentially identical;

a threshold level detector;

an integrator connected to the output of the frequency and phase comparator to integrate that output to a point sufficient to trigger the threshold level detector;

means to conduct the output of the integrator to the input of the threshold level detector; and means to conduct the output of the threshold level detector to the alarm circuit.

11. An apparatus for detecting with a control zone and a marginal area the presence of a transponder having signal mixing capability, as recited in claim 8, further comprising:

a warning circuit; and a means coupled to the signal detecting means for activation of the warning circuit responsive to the detection of the second FM signals, only when the second FM signals predominate over the first FM signals.

12. An apparatus for detecting within a control zone and a marginal area the presence of a transponder having signal mixing capability, as recited in claim 11 wherein the means coupled to the signal detecting means for the activation of the alarm circuit and the activation of the warning circuit responsive to the detection, respectively, of the predominence of the first and the predominence of the second FM signals comprises:

an FM receiver connected to the signal detecting means to select the strongest FM signals;

a first filter connected to the output of the FM receiver to attenuate all FM signals except those having the characteristics of the first FM signals;

the alarm circuit which is connected to the output of the first filter for activation by the output of the first filter;

a second filter also connected to the output of the FM receiver to attenuate all FM signals except those having the characteristics of the second FM signals; and the warning circuit which is connected to the output of the second filter for activation by the output of the second filter.

13. An apparatus for detecting within a control zone and a marginal area the presence of a transponder having a signal mixing capability, as recited in claim 12, wherein the first and second filter comprise:

a first frequency and phase comparator connected to the outputs of both the FM receiver and the first modulation oscillator for comparing the characteristics of the first modulation oscillator output and the FM receiver output and permitting an output from the first frequency and phase comparator only when the first modulation oscillator output and the FM receiver output are essentially identical;

a first threshold level detector;

a first integrator connected to the output of the first frequency and phase comparator to integrate that output to a point sufficient to trigger the first threshold level detector;

means to conduct the output of the first integrator to the input of the first threshold level detector;

means to conduct the output of the first threshold level detector to the alarm circuit;

a second frequency and phase comparator connected to the outputs of both the FM receiver and the second modulation oscillator for comparing the characteristics of the second modulation oscillator output and the FM receiver output and permitting an output from the second frequency and phase comparator only when the second modulation oscillator output and the FM receiver output are essentially identical;

a second threshold level detector;

a second integrator connected to the output of the second frequency and phase comparator to integrate that output to a point sufficient to trigger the second threshold level detector;

means to conduct the output of the second integrator to the input of the second threshold level detector; and means to conduct the output of the second threshold level detector to the warning circuit.

14. An apparatus for detecting within a control zone and a marginal area the presence of a transponder having signal mixing capability, as recited in claim 8, wherein the signal detecting means constructed to detect FM signals only when received as a composite with the HF signals further comprises an HF detector which removes the HF signal from the detected composite HF and FM signals.

* * * * *